United States Patent [19]

Yoshinaga et al.

[11] 4,408,592

[45] Oct. 11, 1983

[54] IGNITION SYSTEM FOR INTERNAL COMBUSTION ENGINES

[75] Inventors: Toru Yoshinaga, Okazaki; Toshihiko Igashira, Toyokawa; Kouichi Mori, Okazaki; Hisasi Kawai, Toyohashi; Seiji Morino, Aichi, all of Japan

[73] Assignee: Nippon Soken, Inc., Nishio, Japan

[21] Appl. No.: 264,693

[22] Filed: May 18, 1981

[30] Foreign Application Priority Data

May 29, 1980 [JP] Japan ..... 55/72276
Nov. 17, 1980 [JP] Japan ..... 55/162229
Nov. 26, 1980 [JP] Japan ..... 55/166180

[51] Int. Cl.[3] ..... F02P 9/00

[52] U.S. Cl. ..... 123/625; 123/629; 123/651

[58] Field of Search ..... 123/609, 610, 625, 626, 123/629, 651

[56] References Cited

U.S. PATENT DOCUMENTS 3,896,776 7/1975 Ford ..... 123/651
3,976,043 8/1976 Canup et al. ..... 123/609
4,176,644 12/1979 Hellberg et al. ..... 123/625
4,237,835 12/1980 Rabus et al. ..... 123/610

FOREIGN PATENT DOCUMENTS 1334230 10/1973 United Kingdom ..... 123/625

*Primary Examiner*—Charles J. Myhre
*Assistant Examiner*—Andrew M. Dolinar
*Attorney, Agent, or Firm*—Cushman, Darby & Cushman

[57] ABSTRACT

An ignition system for internal combustion engines of the type in which after the energizing current flow to the primary winding of an ignition coil has been interrupted and an ignition spark generating high voltage has been produced in the secondary winding, the primary winding is energized again to interrupt the ignition spark. The ignition spark is interrupted at around the TDC only when the engine is at high speed operating conditions and the deenergizing current in the primary winding is not interrupted in a moment but decreased gradually. Also, the ignition spark is interrupted only when the ignition spark is to continue beyond the top dead center.

8 Claims, 9 Drawing Figures

IGNITION SYSTEM FOR INTERNAL COMBUSTION ENGINES

BACKGROUND OF THE INVENTION

The present invention relates to ignition systems for internal combustion engines and more particularly to a control system for controlling the duration time of ignition sparks.

During low speed and low load operation of a spark-ignition engine, the ignition of the mixture is difficult due to a large quantity of the residual burned gases. Moreover, the recent trend toward using exhaust emission controls and lean air-fuel mixtures has made it increasingly important to improve the ignition performance during the periods of low speed and low load operation.

It has been discovered that if the duration time of sparks is increased to more than 2 msec or about 3 msec, for example, as a means for overcoming the foregoing difficulty, the ignition capacity can be increased greatly under such operating conditions.

However, this increased duration time of sparks is disadvantageous in that not only the duration time is wasted during the periods of high speed or high load operation where the ignition performance is good, but also the rate of wear of the spark electrodes is increased considerably. Thus, apparently it has been impossible to accomplish both the increased ignition capacity and the avoidance of the wear of the plug electrodes at a time.

However, the inventors, etc., have discovered that the wear of the electrodes of spark plugs is mostly attributable to the discharge after the piston has passed the top dead center on the compression stroke and that the discharge occuring before the top dead center on the compression stroke practically contributes nothing to the wear of the electrodes.

This is considered to be due to the fact that the occurrence of discharge in the presence of a high pressure, high temperature and flame promotes the rate of wear of the spark plug electrodes.

Also, the studies made by the inventors, etc., have shown that the discharge occurring after the top dead center on the compression stroke means practically no contribution to the ignition. As a result, there has existed a need for an ignition system so designed that the spark is not allowed to continue beyond the top dead center on the compression stroke and that the spark is maintained as far as possible during the periods of low speed and low load operation.

To meet these requirements, as disclosed in the specification of U.S. Pat. No. 3,896,776, a system has been proposed in which when the top dead center (TDC) position is reached, the primary winding is energized to cut off the secondary discharge. In this system, a first voltage pulse train and a second voltage pulse train are produced so that in response to the positive-going transition of the first voltage pulse train, the second voltage pulse train including a much greater number of pulses than the first voltage pulse train is computed to determine the starting point of ignition and in response to the negative-going transition of the first voltage pulse train the primary winding of the ignition coil is energized to cut off the secondary discharge. Thus, the primary winding is held "OFF" during the time interval between the production of a spark at the ignition starting point and the termination of the spark at the TDC and the primary winding is held "ON" throughout the other periods. In accordance with this characteristic diagram the calculation of the ON and OFF periods of the primary winding shows that the corresponding ON and OFF periods for every 1/2 engine revolution are respectively 4.3 ms and 0.7 ms with the OFF/ON ratio of 16% at the engine speed of 6000 rpm, 8.9 ms and 1.1 ms with ratio of 12% at 3000 rpm and 48.3 ms and 1.7 ms with the ratio of 3.5% at 600 rpm. As a result, there is a disadvantage that if the ignition control is performed according to this control system throughout the speeds of an engine, the ignition coil generates heat and eventually it is burned out.

SUMMARY OF THE INVENTION

With a view to overcoming the foregoing deficiencies in the prior art, it is an object of the present invention to provide an improved ignition system so designed that the control system of this invention is allowed to function only during operations where the engine speed is high and thus the corresponding OFF/ON ratio is large, and the conventional ignition control method is allowed to function at the low engine speeds.

While, after the primary winding has been energized to cut off the secondary discharge, it is desirable to deenergize the primary winding at the expiration of a predetermined time, this has the disadvantage of producing a harmful high voltage in the secondary winding upon deenergization of the primary winding.

It is therefore another object of the present invention to provide such an ignition system in which in order to deenergize the primary winding after the reenergization thereof, the current flow in the primary winding is not cut off in a moment but decreased gradually thereby overcoming the above-mentioned deficiency without inducing any high voltage in the secondary winding.

As mentioned previously, the results of the studies made by the inventors have clarified the following two points. (1) In the case of an ignition spark before the top dead center on the compression stroke, the ignition capacity increases with increase in the duration time and the spark contributes practically nothing to the wear of the plug electrodes. (2) In the case of an ignition spark produced after the top dead center on the compression stroke, the rate of wear of the plug electrodes increases with increase in the duration time and the spark contributes practically nothing to the improvement of the ignition capacity. As a result, where it is evident that the ignition spark does not continue beyond the top dead center on the compression stroke (e.g., during the low speed operation or the low load operation where the ignition timing is extremely early), the reenergization of the primary winding is not only wasteful but also involves the danger of causing overheating of the ignition coil.

It is therefore still another object of the present invention to provide such an ignition system in which whether the ignition spark will continue beyond the top dead center on the compression stroke is determined so that only when the spark will continue past the top dead center on the compression stroke, at a predetermined point before or after the top dead center on the compression stroke the primary winding of the ignition coil is energized again to interrupt the ignition spark and thereby to prevent overheating of the ignition coil.

Therefore, according to one aspect of the present invention, there is provided an ignition system for an internal combustion engine comprising an ignition coil having a primary and secondary winding generating a spark voltage when said primary winding is deenergized, engine speed detecting means, first signal generating means for generating a first signal having two output levels one and the other of which are indicative of energization and deenergization of said primary winding respectively, and switching means for permitting energization and deenergization of said primary winding in response to said one and the other of said two output levels of said first signal respectively, said system further comprising second signal generating means for generating a second signal when an engine output shaft arrives at a predetermined angular position close to the top dead center position of said output shaft, and control means for energizing said primary winding in response to said second signal and said other of said two output levels in such an engine operating condition that the ratio of deenergization period to energization period of said primary winding becomes higher than a predetermined value.

Further objects, features and advantages of the present invention are described with reference to the following accompanying drawings.

DESCRIPTION OF THE PREFERRED EMBODIMENTS

The present invention will now be described in greater detail with reference to the illustrated embodiments.

Figure 1:
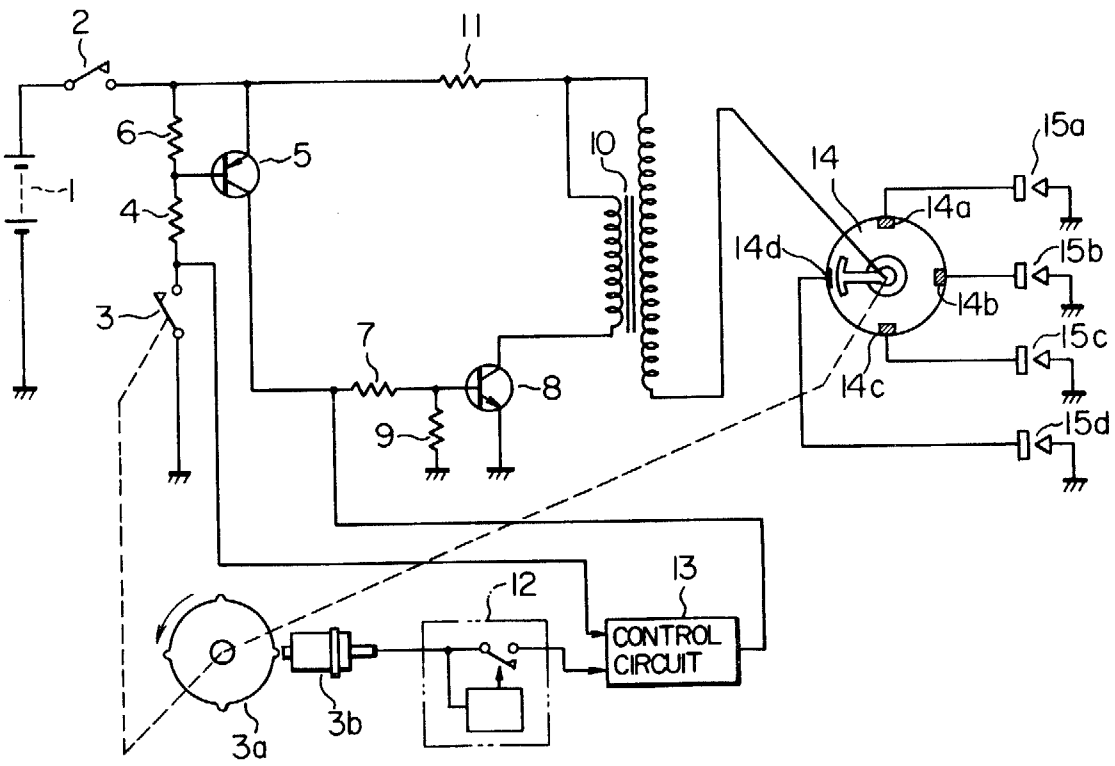
FIG. 1 is a circuit diagram showing an embodiment of a system according to the present invention.

Referring to FIG. 1 showing a first embodiment of the invention, numeral 1 designates a battery having its negative terminal grounded. Numeral 2 designates a key switch having its one end connected to the positive terminal of the battery 1. Numeral 3 designates a breaker contact incorporated in a distributor unit to serve as an ignition signal generator, and the breaker contact 3 has its one end grounded and its other end connected to one end of a resistor 4. The other end of the resistor 4 is connected to the base of a PNP transistor 5. The emitter of the transistor 5 is connected to the other end of the key switch 2. A resistor 6 is connected across the emitter and base of the transistor 5. The collector of the transistor 5 is connected to one end of a resistor 7 whose other end is connected to the base of an NPN power transistor 8. The emitter of the power transistor 8 is grounded. A resistor 9 is connected across the base and emitter of the power transistor 8. The collector of the power transistor 8 is connected to one end of the primary winding of an ignition coil 10. The other end of the primary winding of the ignition coil 10 and one end of its secondary winding have a common connection to one end of a resistor 11. The other end of the resistor 11 is connected to the other end of the key switch 2. The secondary winding of its ignition coil 10 is connected to a high voltage distributor 14 of the distributor unit. The high voltage distributing section of the distributor 14 includes electrodes **14*a*, 14*b*, 14*c* and 14*d* respectively associated with spark plugs 15*a*, 15*b*, 15*c* and 15*d*** of the respective cylinders.

Numeral **3*a* designates a rotor of magnetic material incorporated in the distributor unit. The present embodiment is applied to a four-cylinder internal combustion engine and consequently the rotor 3*a* includes four equally spaced projections each positioned near the top dead center (TDC) of the associated cylinder. The projections are detected by a sensor 3*b*. The sensor 3*b* comprises a known type of magnet pickup. The output of the sensor 3*b* is connected to a discrimination switch circuit 12. The discrimination switch circuit 12 comprises a reshaping circuit for reshaping the TDC signal from the sensor 3*b*, a discrimination circuit for counting the number of the pulses from the reshaping circuit (or the number of the output pulses from the transistor 5 may be counted) to generate a signal when the count exceeds a predetermined number of revolutions of 4000 rpm, for example, and a switch circuit adapted to be opened and closed in response to the output signal of the discrimination circuit, thus applying a reshaped TDC signal to a control circuit 13 when the engine speed becomes higher than the predetermined rotational speed. The control circuit 13 receives the signal from the discrimination switch circuit 12 and the signal from the breaker contact 3 to generate a signal for controlling the primary current in the ignition coil 10. Its construction comprises a reshaping circuit for preventing the introduction of chattering from the breaker contact 3 and a flip-flop circuit adapted to be reset by the signal applied from the reshaping circuit and indicative of the opening of the breaker contact 3 and set by the TDC signal from the discrimination switch circuit 12**.

It should be noted that if a TDC signal retarding circuit which is based on the known technique of electronic advance unit and which is not shown is connected between the sensor **3*b* and the discrimination switch circuit 12** to form a TDC signal generator, it is possible to control the TDC signal retarding circuit in accordance with the engine speed and load to change the position at which the TDC signal is generated.

Figure 2:
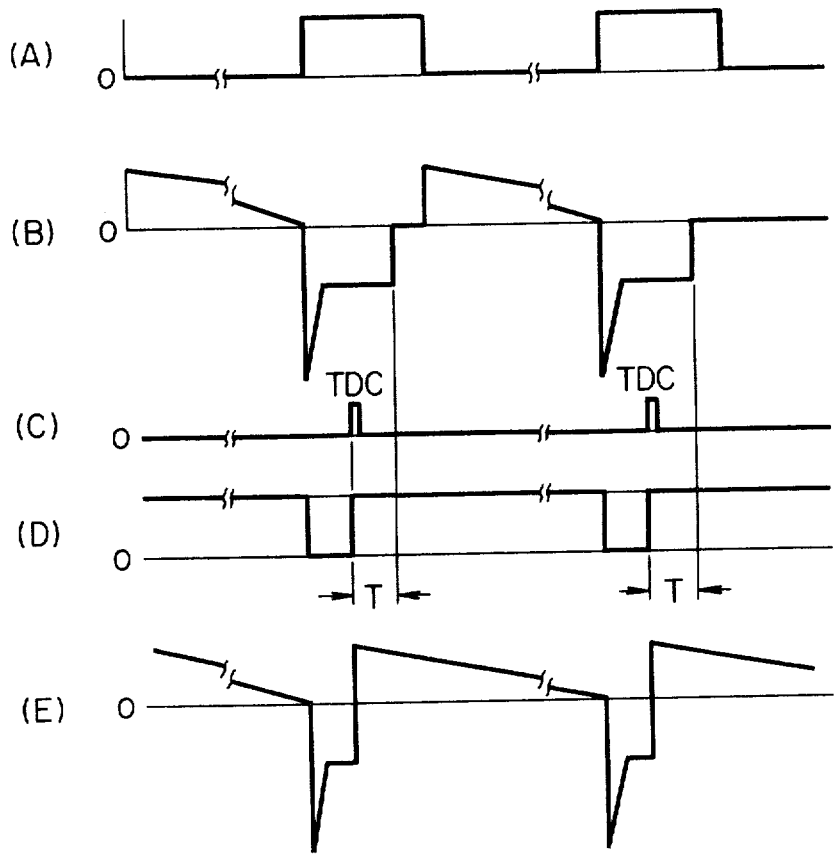
FIG. 2 shows a plurality of waveforms which are useful for explaining the operation of the system shown in FIG. 1.

With the construction described above, the operation of the first embodiment will now be described briefly. The key switch 2 is closed first and the distributor breaker contact 3 is opened and closed since the engine is in operation. As a result, when the breaker contact 3 is closed, the transistor 5 is turned on and the current flows via the resistor 7 and the base-emitter section of the power transistor 8. Thus, the power transistor 8 is turned on and the current flows to the primary winding of the ignition coil 10 forming the load. Then, as the breaker contact 3 is opened, the transistor 5 is turned off and the power transistor 8 is also turned off, thus interrupting the primary current in the ignition coil 10. At this instant, a high voltage is produced in the ignition coil secondary winding and a spark is produced at the proper spark plug. FIG. 2 shows the waveforms generated in this case. Shown in (A) of FIG. 2 is the base voltage waveform of the transistor 5, and shown in (B) of FIG. 2 is the secondary high voltage waveform of the ignition coil 10 when the control circuit 13 is not in operation.

On the other hand, the sensor 3*b* detects the signal from the rotor 3*a* rotated in synchronism with the breaker contact 3. The output signal of the sensor 3*b* serves the dual function of indicating the engine speed and the TDC position. When the engine speed exceeds 4000 rpm, for example, the discrimination switch circuit 12 generates a TDC signal as its output signal. In this case, a hysteresis circuit is incorporated so as to prevent chattering of the output signal of the discrimination switch circuit 12 when the engine speed is increasing and decreasing, respectively. Shown in (C) of FIG. 2 is the output signal of the discrimination switch circuit 12 when it is in operation.

When the breaker contact 3 is opened, the flip-flop of the control circuit 13 is reset and the flip-flop is set by the TDC signal from the discrimination switch circuit 12, thus generating the signal shown in (D) of FIG. 2. This output signal turns on the transistor 8 and the primary winding of the ignition coil 10 is controlled. In this case, it should be noted that if a spark discharge is being produced in the secondary winding by the deenergization of the primary winding, the spark discharge can be stopped by supplying again the current to the primary winding.

In this way, after the ignition spark is produced at the spark plug, the spark discharge is stopped at around the TDC at which the combustion begins. Shown in (E) of FIG. 2 is the secondary high voltage waveform generated in the ignition coil 10 at this time. As will be seen from FIG. 2, the spark discharge is interrupted during the time interval T.

Also, since the primary winding is deenergized for less than 1 ms as will be seen from FIG. 2, if the control circuit 13 is brought into operation when the engine speed is low, there is the disadvantage of the primary winding being energized practically continuously. On the other hand, when the engine speed becomes higher than 4000 rpm, the corresponding energization and deenergization periods respectively become about 4 ms and 2 ms even in the case of the conventional ignition coil. Thus, even if the control circuit 13 is operated at around this engine speed, the power consumption and the heat generation of the ignition coil 10 become equal to those of the conventional ignition coil.

Also, since the spark discharge is for the most part terminated before the TDC at low engine speeds, if the control circuit 13 is operated only at high engine speeds where the spark discharge continues even after the TDC, the effect of preventing the wear of spark plugs will be great.

While, in the above-described embodiment, the control circuit 13 is operated in accordance with the engine speed alone, a greater effect will be obtained if the engine load condition is detected so that the control circuit 13 is also brought into operation when the engine load becomes greater than a predetermined value.

It will thus be seen that since the first embodiment of this invention comprises an ignition coil having a primary winding and secondary winding for producing a spark generating high voltage, a TDC signal generator for detecting near the TDC of each cylinder in synchronism with the rotation of the engine crankshaft so as to generate a TDC signal, a discrimination switch circuit for detecting the engine speed to deliver the TDC signal when the engine speed is higher than a predetermined value, and a control circuit responsive to the output signal of the discrimination switch circuit and the ignition signal from an ignition signal generator to determine the time of conduction of the primary current to the ignition coil 10, ignition sparks of the conventional nature are produced at low engine speeds where the effect on the wear of the spark plugs is less and the ignition spark is interrupted at near the TDC at high engine speeds where the effect on the wear of the spark plugs is large, thus making the system practical and reducing the wear of spark plugs.

There is another great advantage that by interrupting the ignition spark in accordance with the engine conditions such as the engine speed and the engine load instead of interrupting the ignition spark at around the TDC in an unvarying manner, it is possible to further decrease the wear of spark plugs.

Figure 3:
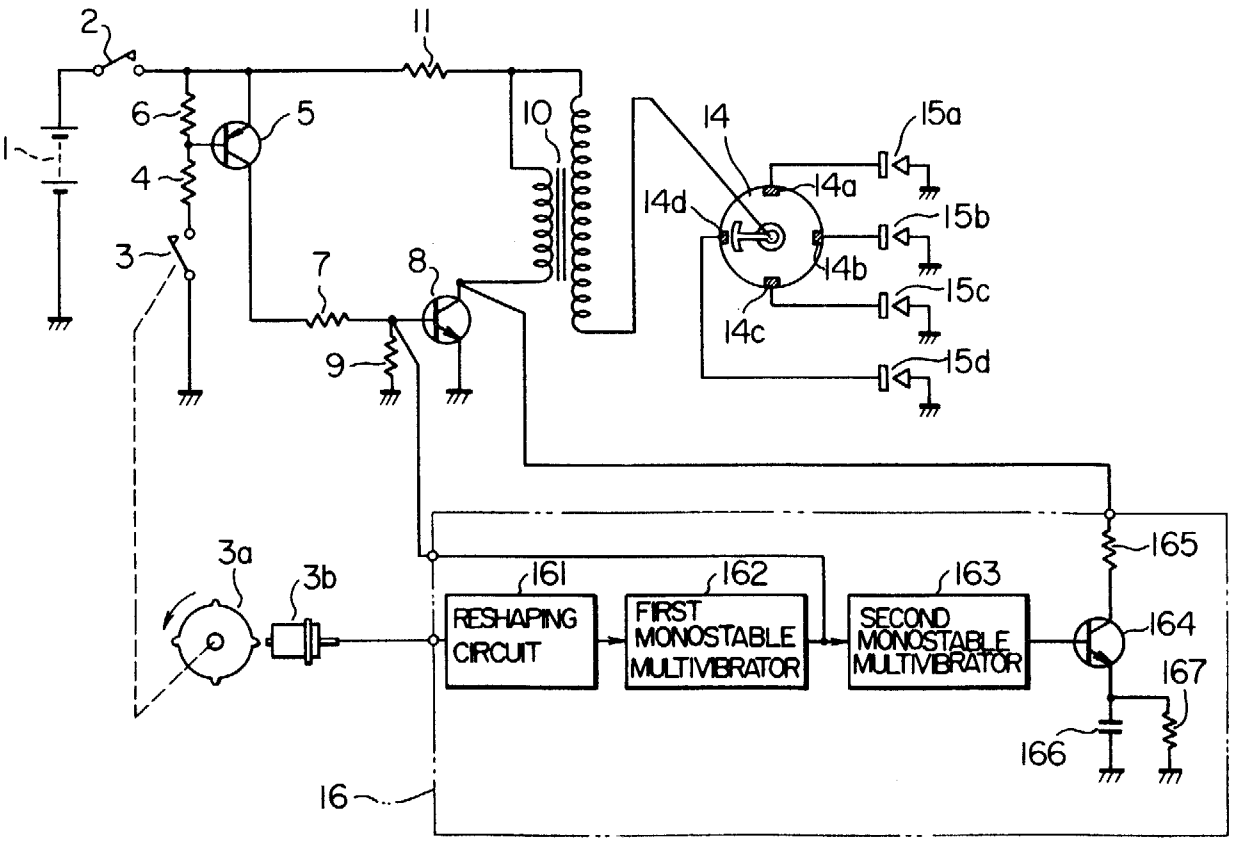
FIG. 3 is a circuit diagram showing a second embodiment of the system according to the invention.
Figure 4:
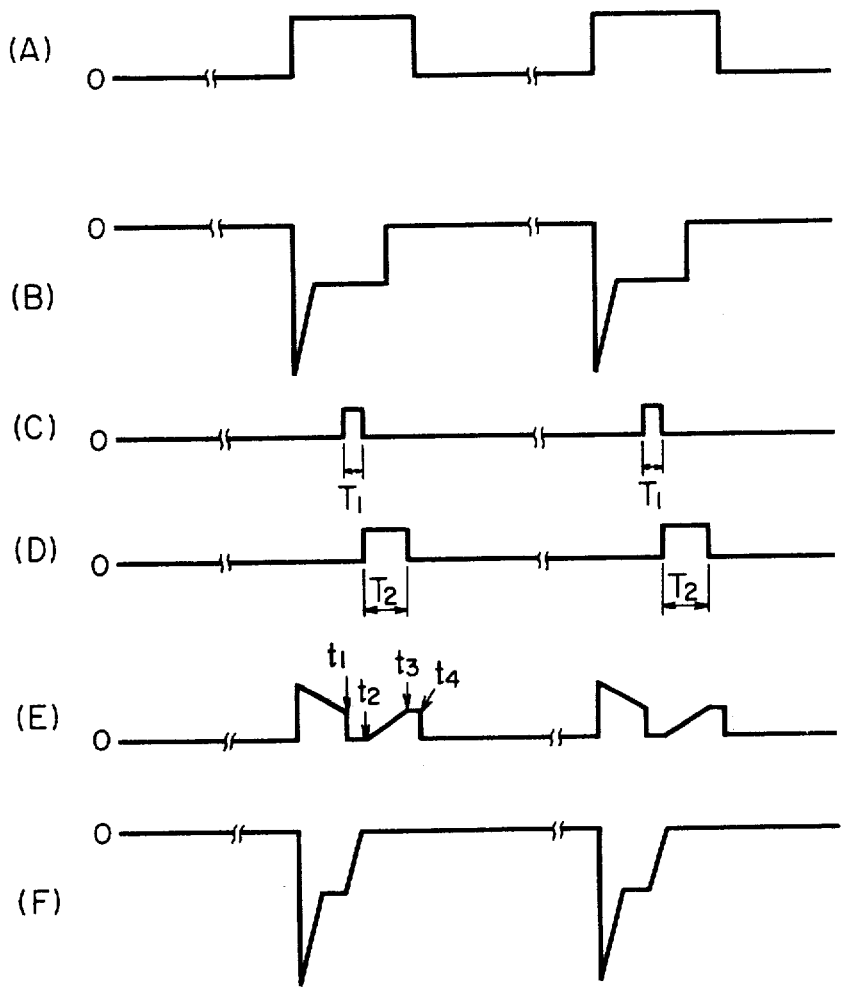
FIG. 4 shows a plurality of waveforms which are useful for explaining the operation of the system shown in FIG. 3.

A second embodiment of the invention in which the current supplied again for primary winding reenergization purposes is decreased gradually will now be described with reference to FIG. 3. In the Figure, the same reference numerals as used in FIG. 1 designate the identical components, and the output of the sensor 3*b* is connected to the input terminal of a control circuit 16. The input terminal of the control circuit 16 is connected to a reshaping circuit 161 to reshape the output signal of the sensor 3*b* to a rectangular waveform. The output terminal of the reshaping circuit 161 is connected to a first monostable multivibrator 162 which in turn generates a pulse of about 100 μs. The output of the first monostable multivibrator 162 is connected to a second monostable multivibrator 163 which in turn generates a pulse of about 1 ms. The output of the first monostable multivibrator 162 forms the first output of the control circuit 16 and it is connected to the base of the power transistor 8. The output of the second multivibrator 163 is connected to the base of a transistor 164. The collector of the transistor 164 forms the second output of the control circuit 16 via a resistor 165 and is connected to the collector of the power transistor 8. One end of a capacitor 166 and one end of a resistor 167 have a common connection to the emitter of the transistor 164. The other ends of the capacitor 166 and the resistor 167 are both grounded. The control circuit 16 is responsive to the TDC signal from the sensor 3*b* so that the power transistor 8 is turned on and then it is turned off after the expiration of a predetermined time. At the same time, the primary current is gradually decreased and eventually interrupted.

with the construction described above, the operation of the second embodiment is as follows. The key switch 2 is first closed and the breaker contact 3 of the distributor unit is closed and opened since the engine is in operation. As a result, when the breaker contact 3 is closed, the transistor 5 is turned on and the current flows through the resistor 7 and the base-emitter section of the power transistor 8. Thus, the power transistor 8 is turned on and the current flows to the primary winding of the ignition coil 10 forming the load. Then, when the breaker contact 3 is opened, the transistor 5 is turned off so tha the power transistor 8 is turned off and the primary current in the ignition coil 10 is interrupted. At this moment, a high voltage is produced in the secondary winding and a spark is produced at the proper spark plug. Shown in (A) of FIG. 4 is the base voltage waveform of the transistor 5, and shown in (B) of FIG. 4 is the secondary high voltage waveform of the ignition coil 10 when the control circuit 16 is not in operation.

On the other hand, the sensor 3*b* detects the signal from the rotor 3*a* rotated in synchronism with the breaker contact 3. The output signal of the sensor 3*b* indicates the TDC position. The control circuit 16 reshapes the signal from the sensor 3*b* by the reshaping circuit 161. In response to the reshaped signal, the first monostable multivibrator 162 generates a pulse of a predetermined width $T_1$ (about 100 μs) as shown in (C) of FIG. 4. Then, in response to the signal from the first monostable multivibrator 162, the second monostable multivibrator 163 generates a pulse of a predetermined width $T_2$ (about 1 ms) as shown in (D) of FIG. 4. When the pulse $T_1$ is applied to the base of the transistor 8, the primary winding of the ignition coil 10 is energized. Shown in (E) of FIG. 4 is the primary winding voltage waveform generated at this time, and the power transistor 8 is turned on in response to the pulse $T_1$ at a time $t_1$. When this occurs, the high voltage produced in the secondary winding is terminated with a sharp slope by the time that the time period $T_1$ elapses. After the time period $T_1$ has elapsed, the power transistor 8 is turned off and simultaneously the transistor 164 is turned on. When the transistor 164 is turned on at the time $t_2$ in FIG. 4, the current flows to the capacitor 166 via the primary winding and the resistor 165 and the current through the primary winding flows until the capacitor 166 is charged fully at the time $t_3$. In the time interval between the time $t_3$ and the time $t_4$ the capacitor 166 has already been charged fully. Then, by gradually decreasing the current flow in the primary winding in accordance with the current supplied to the capacitor 166, no high voltage is produced in the secondary winding. Then, at a time $t_4$ the power transistor 8 starts supplying the normal current to the primary winding. Shown in (F) of FIG. 4 is the voltage waveform generated in the secondary winding. The resistor 167 is provided to discharge the charge on the capacitor 166 when the transistor 164 is turned off and it has a sufficiently large resistance value as compared with the resistor 165. In this case, what is to be noted is the fact that when the primary winding current is interrupted rapidly so that a spark discharge is produced in the secondary winding, the spark discharge is stopped if the current is again supplied to the primary winding and no high voltage is produced in the secondary winding if the current flow in the primary winding is gradually interrupted. In this way, when a spark is produced at each of the spark plugs 15*a* and 15*d*, the spark discharge is prevented at around the TDC at which the combustion starts.

While, in the above-described second embodiment, a TDC signal is generated and detected, where any other crank angle position signal is available, a TDC signal generator may be provided by inserting a TDC signal retarding circuit which utilizes the technique of known electronic advance unit and which is not shown so as to control the TDC signal retarding circuit in accordance with the engine speed and the engine load and thereby to change the position at which the TDC signal is produced.

Further, while, in the above-described second embodiment, the second output of the control circuit 16 is connected to the collector of the power transistor 8 so as to directly control the primary current in the ignition coil 10 through the second output, the second output of the control circuit 16 may for example be connected to the base of the transistor 5 so that the power transistor 8 is operated via the second output so as to control the primary current in the ignition coil 10.

It will thus be seen that since the second embodiment of the invention comprises an ignition coil having a primary winding and secondary winding for generating a spark generating high voltage, an ignition signal generator for generating an ignition signal to determine the times of switching on and off the primary current in the ignition coil, and a control circuit whereby in synchronism with the rotation of the engine crankshaft the top dead center or so of each of the cylinders is detected so that in accordance with this detection signal, a signal is generated to switch on again the primary current in the ignition coil and upon termination of the signal the primary current in the ignition coil is interrupted gradually, there is a great advantage that the ignition spark is interrupted at around the TDC without causing the generation of heat in the ignition coil and irrespective of the engine speed, thus reducing the wear of the spark plugs.

Another advantage is that the circuit construction is simplified by virtue of the fact that the two outputs of the control circuit are respectively connected to the base and collector of the power transistor adapted to operate the ignition coil.

Next, third and fourth embodiments of the invention in which whether the ignition spark will continue beyond the top dead center is determined to determine whether the primary winding of the ignition coil is to be energized again, will be described with reference to FIGS. 5 to 9.

Figure 5:
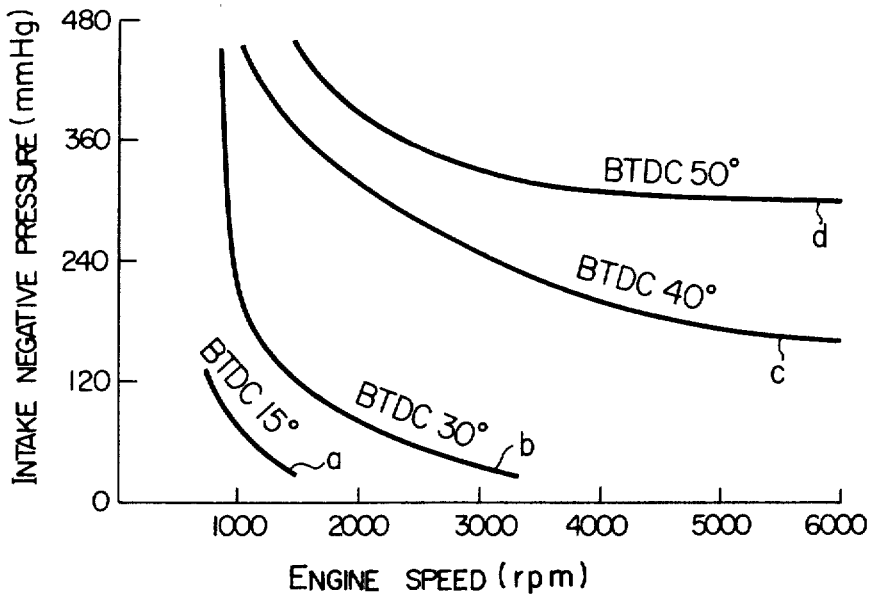
FIG. 5 is a characteristic diagram showing by way of example the ignition timings (the starting points of occurrence of an ignition spark) of an internal combustion engine.

FIG. 5 shows by way of example the ignition timings of an internal combustion engine. Generally, the ignition timing refers to the starting point of generation of an ignition spark.

Figure 6:
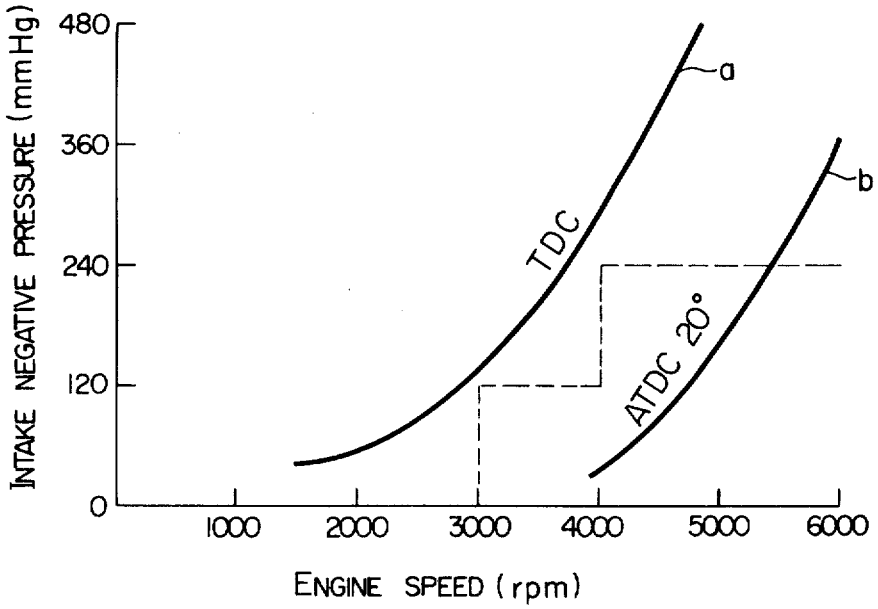
FIG. 6 is a characteristic diagram showing the ignition spark ending points of the engine.

In FIG. 5, the abscissa represents the engine speed and the ordinate represents the negative pressure in the intake pipe. Also the curves a to d respectively show the uniform ignition timing characteristics corresponding to 15°, 30°, 40° and 50° BTDC (Before Top Dead Center), respectively. In this case, if the duration time of the ignition sparks is 2 msec, then the ending points of the ignition sparks become as shown in FIG. 6. In FIG. 6, the abscissa represents the engine speed and the ordinate represents the negative pressure in the intake pipe. Also the curves a and b respectively show the uniform timing characteristics corresponding to the ignition spark ending times of TDC (Top Dead Center) and 20° ATDC (After Top Dead Center), respectively. In accordance with FIG. 6, under the conditions to the right of the curve a corresponding to the TDC the ignition spark will be continued beyond the TDC on the compression stroke and thus it is necessary to interrupt the ignition spark art a particular point before or after the TDC on the compression stroke. This can be accomplished by a first method comprising detecting the ignition starting point and the engine speed, computing the ending point of the ignition spark on the assumption that the duration time of the spark is 2 msec, for example, and then, if the computed ending point is after the TDC on the compression stroke, supplying again a pulse-like current to the primary winding of the ignition coil at a predetermined time before or after the TDC on the compression stroke, thus interrupting the ignition spark. This method will now be described as the third embodiment.

The same can be accomplished by a second method in which the engine speed and the intake negative pressure are detected so that if the engine condition is determined to lie to the right of the broken line in FIG. 6, the ignition spark is interrupted by supplying again a pulse-like current to the primary winding of the ignition coil at a predetermined time before or after the TDC on the compression stroke. This second method will be described as the fourth embodiment.

Figure 7:
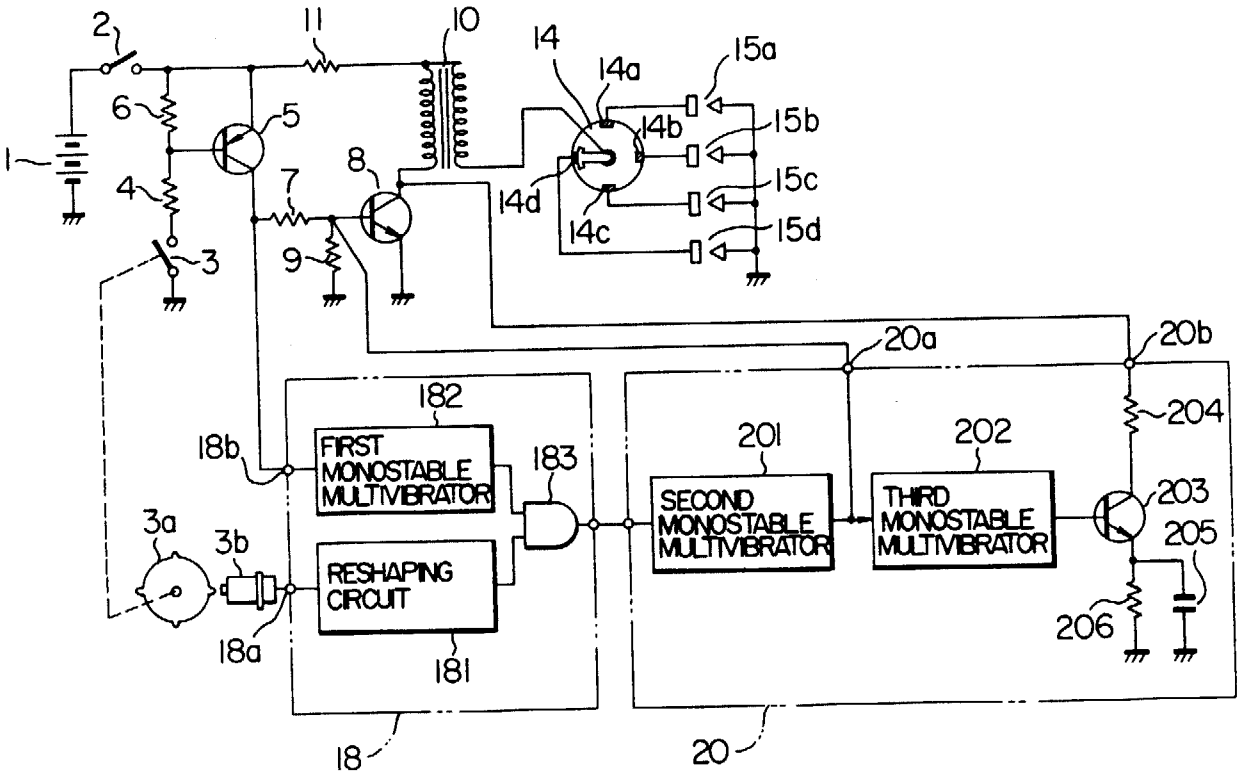
FIG. 7 is a circuit diagram showing a third embodiment of the system according to the present invention.

The present invention will now be described first with reference to the third embodiment shown in FIG. 7. In the Figure, the same reference numerals as used in FIGS. 1 and 3 designate the identical component parts. In the present embodiment, the output of the sensor 3*b* is connected to a first input 18*a* of an input circuit 18. The collector of the transistor 5 is connected to a second input 18*b* of the input circuit 18. A reshaping circuit 181 is connected to the first input 18*a* of the input circuit 18 so as to reshape the signal from the sensor 3*b*. A first monostable multivibrator 182 is connected to the second input 18*b* of the input circuit 18 so that when the breaker contact 3 is opened, a pulse of about 2 ms is generated at the output of the multivibrator 182. The reshaping circuit 181 is connected to one input of an AND gate 183 whose other input is connected to the first monostable multivibrator 182. The output of the AND gate 183 is connected to the input of a control circuit 20. A second monostable multivibrator 201 is connected to the input of the control circuit 20 and the multivibrator 201 generates at its output a pulse of about 100 msec in synchronism with the signal from the input circuit 18. The output of the second monostable multivibrator 201 is connected to a third monostable multivibrator 202 which generates at its output a pulse of about 1 ms. The output of the second monostable multivibrator 201 is connected as the first output 20*a* of the control circuit 20 to the base of the power transistor 8. The output of the third monostable multivibrator 202 is connected to the base of a transistor 203. The collector of the transistor 203 is connected to the collector of the power transistor 8 through a resistor 204 and via the second output 20*b* of the control circuit 20. One end of a capacitor 205 and one end of a resistor 206 have a common connection to the emitter of the transistor 203. The other ends of the capacitor 205 and the resistor 206 are both grounded. The input circuit 18 and the control circuit 20 function so that in response to the TDC signal from the sensor 3*b* the power transistor 8 is turned on and it is then turned off at the expiration of a predetermined time, simultaneously decreasing the current in the primary winding gradually and eventually interrupting the primary current.

Figure 8:
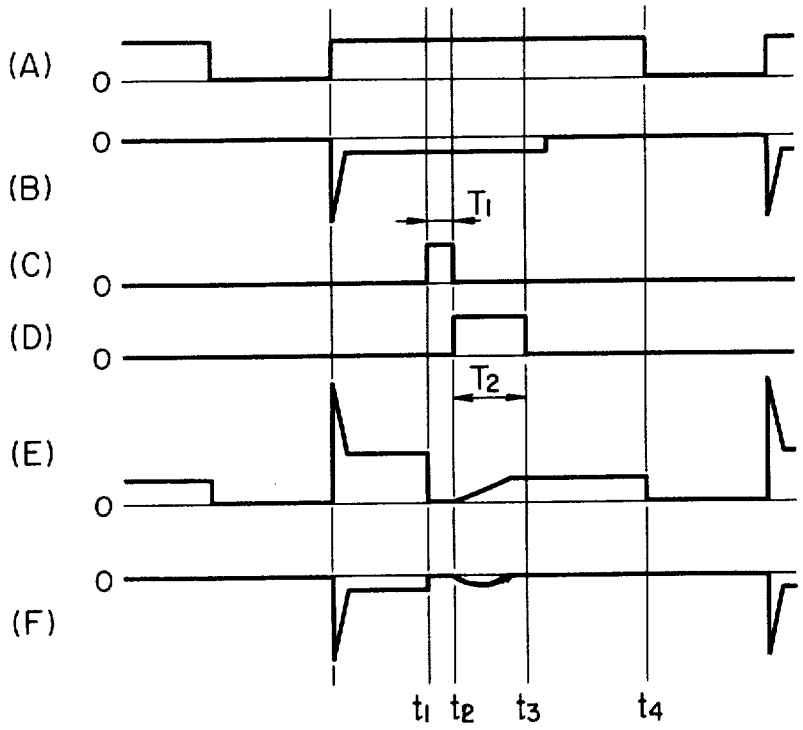
FIG. 8 shows a plurality of waveforms which are useful for explaining the operation of the third embodiment.

With the construction described above, the operation of the third embodiment will now be described briefly. The key switch 2 is first closed so that the breaker contact 3 is closed and opened since the engine is in operation. As a result, when the breaker contact 3 is closed, the transistor 5 is turned on, causing the flow of current via the resistor 7 and the base-emitter section of the power transistor 8. When this occurs, the power transistor 8 is turned on and the current flows to the primary winding of the ignition coil 10 forming the load. Then, when the breaker contact 3 is opened, the transistor 5 is turned off so that the power transistor 8 is turned off and the primary current in the ignition coil 10 is interrupted. At this moment, a high voltage is produced in the secondary winding and a spark is produced at the proper spark plug. FIG. 8 shows the waveforms generated in this case. Shown in (A) of FIG. 8 is the base voltage waveform of the transistor 5, and shown in (B) of FIG. 8 is the secondary high voltage waveform of the ignition coil 10 when the control circuit 20 is not in operation.

On the other hand, the sensor 3*b* detects the signal from the rotor 3*a* rotated in synchronism with the breaker contact 3. The output signal of the sensor 3*b* is indicative of the TDC position. The signal from the sensor 3*b* is reshaped by the reshaping circuit 181 of the input circuit 18 via the first input 18*a*. On the other hand, the signal from the transistor 5 is applied to the first monostable multivibrator 182 via the second input 18*b*, thus generating a pulse of a predetermined width (about 2 msec) after the opening of the breaker contact 3. The outputs of the reshaping circuit 181 and the first monostable multivibrator 182 are applied to the AND gate 183 so that if there is the TDC signal from the reshaping circuit 181 within the time interval of 2 msec after the opening of the breaker contact 3, the AND gate 183 generates an output, and the AND gate 183 generates no output when there is no TDC signal. The output of the AND gate 183 is applied to the control circuit 20 and consequently the second monostable multivibrator 201 generates a pulse of a predetermined width $T_1$ (about 100 $\mu$s) as shown in (C) of FIG. 8. Also, in response to the output of the second monostable multivibrator 201 the third monostable multivibrator 202 generates a pulse of a predetermined width $T_2$ (about 2 ms) as shown in (D) of FIG. 8. Shown in (E) of FIG. 8 is the resulting voltage waveform in the primary winding, and the power transistor 8 is turned on in response to the application of the pulse $T_1$ at the time $t_1$. When this occurs, the high voltage produced in the secondary winding is extinguished with a sharp slope by the time that the time period $T_1$ elapses. After the time period $T_1$ has expired, the power transistor 8 is turned off and simultaneously the transistor 203 is turned on by the pulse $T_2$. When the transistor 203 is turned on at the time $t_2$ in FIG. 8, the current flows to the capacitor 205 via the resistor 204 until the capacitor 205 is charged fully. In the time interval between the time $t_3$ and the time $t_4$ the capacitor 205 has been charged fully. In this case, by gradually decreasing the current flow in the primary winding in accordance with the current supplied to the capacitor 205, no high voltage is generated in the secondary winding. Then, the supply of the normal current to the primary winding is started by the power transistor 8 at the time $t_4$. Shown in (F) of FIG. 8 is the voltage waveform in the secondary winding. The resistor 206 is provided to discharge the charge on the capacitor 205 when the transistor 203 is turned off and its resistance value is selected sufficiently large as compared with the resistor 204.

In this case, what is to be noted is the fact that when the current in the primary winding is interrupted rapidly so that a spark discharge occurs in the secondary winding, if the primary winding is supplied with current again, the spark discharge is stopped, and if the current in the primary winding is interrupted gradually, a high voltage is not generated in the secondary winding.

Figure 9:
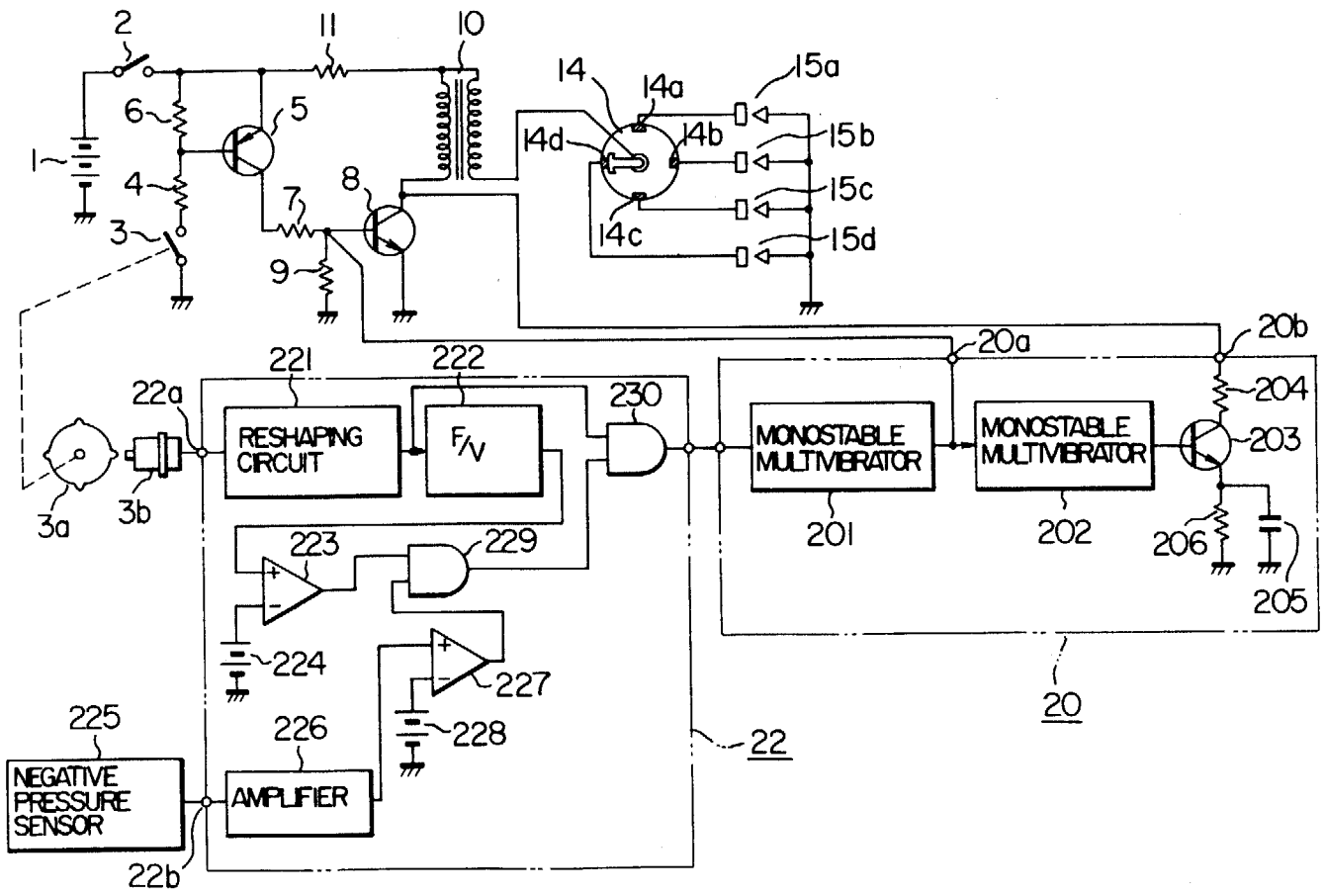
FIG. 9 is a circuit diagram showing a fourth embodiment of the system according to the present invention.

The fourth embodiment will now be described with reference to FIG. 9. In the Figure, all the component parts except an input circuit 22 are identical with their counterparts in FIG. 7 and these common component parts will not be described. This output of the sensor 3*b* is connected to the first input 22a of the input circuit 22 and thus the sensor output is reshaped by a reshaping circuit 221. The output of the reshaping circuit 221 is connected to the input of an F/V (Frequency/Voltage) converter 222. The output of the F/V converter 222 is connected to the first input of a first comparator 223 whose second input is connected to a reference voltage 224. On the other hand, a negative pressure sensor 225 for detecting the negative pressure in the engine intake pipe has its output connected to the input of an amplifier 226 through the second input 22b of the input circuit 22. A second comparator 227 has its first input connected to the output of the amplifier 226 and its second input connected to a reference voltage 228. A first AND gate 229 has its two inputs respectively connected to the output of the first comparator 223 and the output of the second comparator 227. A second AND gate 230 has its two inputs respectively connected to the output of the first AND gate 229 and the output of the reshaping circuit 221. The output of the second AND gate 230 is connected to the input of the control circuit 20.

With the construction described above, the operation of the input circuit 22 will now be described briefly. The output of the sensor 3b is reshaped by the reshaping circuit 221 whose output is in turn applied to the F/V converter 222, thus generating an output power proportional to the engine speed. The output of the F/V converter 222 is compared with the reference voltage 224 by means of the first comparator 223 so that when the engine speed exceeds a predetermined value, the first comparator 223 generates an output. On the other hand, the output of the negative pressure sensor 225 is amplified by the amplifier 226 and the amplified output is compared with the reference voltage 228 by the second comparator 227 which generates an output when the negative pressure exceeds a predetermined value. When each of the first and second comparators 223 and 227 generates an output, the first AND gate 229 generates an output and the output of the reshaping circuit 221 appears at the output of the second AND gate 230. In the like manner as the third embodiment, the output of the second AND gate 230 operates the control circuit 20 and the primary current in the ignition coil 10 is controlled.

In this way, after an ignition spark is produced at the spark plug, the spark discharge is stopped at around the TDC at which the combustion begins.

While, in the above-described third embodiment, a TDC signal is generated and detected, where other crank angle position signal is available, if a TDC signal generator is formed by inserting a TDC signal retarding circuit which utilizes the technique of the known electronic advance unit and which is not shown, it is possible to control the TDC signal retarding circuit in accordance with the engine speed and the engine load and thereby to change the position at which the TDC signal is generated.

Further, in the above-described third embodiment the duration time of a spark is assumed to be 2 ms and whether the spark will continue beyond the TDC on the compression stroke is determined.

To be exact, however, the spark duration time varies to some extent depending on different conditions. For instance, the duration time varies in the range from 1.5 to 2.0 ms or in the range from 2.0 to 3.0 ms. In such a case, it is only necessary to assume the shortest duration time and make the determination accordingly. In the case of a spark discharge of a nature tending to continue only slightly beyond the top dead center, the detrimental effect of the spark discharge on the electrode wear is small even if the spark discharge is not interrupted forcibly.

Further, while, in the above-described fourth embodiment, the engine speed and the intake pipe negative pressure are detected to determine whether they are in such condition zone that the spark will continue beyond the top dead center, it is possible to more directly detect the engine speed and the ignition timing and thereby to determine whether they are in such condition zone that the spark will continue beyond the top dead center. For instance, in the case of FIG. 6, the zone requiring the interruption of spark discharge corresponds to the crank angles later than 36° BTDC when the engine speed is 3000 rpm and the same corresponds to the crank angles later than 48° BTDC when the engine speed is 4000 rpm.

Further, while, in the fourth embodiment, the intake negative pressure is detected as a means of detecting the engine load, in the case of an engine including an air-flow sensor the output of the air-flow sensor may be used.

It will thus be seen from the foregoing that in accordance with the above described embodiments, by virtue of the fact that whether the ignition spark will continue beyond the top dead center on the compression is determined so that only when it is determined that the ignition spark will continue beyond the top dead center on the compression stroke the primary winding of the ignition coil is again energized at a predetermined time around the top dead center on the compression stroke so as to interrupt the ignition spark, there is a great advantage that the wear of the plug electrodes can be reduced without the danger of overheating the ignition coil.

Another great advantage is that if the ignition spark is interrupted by reenergizing the primary winding with a reenergizing current of a pulse-like form including an abrupt rise portion and a gradual decline portion, the generation of heat by the ignition coil can be reduced and also the occurrence of any wasteful spark upon termination of the reenergizing pulse can be prevented.

We claim:

1. An ignition system for an internal combustion engine comprising:

an ignition coil having a primary and secondary winding generating a spark voltage when said primary winding is deenergized, first signal generating means for generating a first signal having two output levels, switching means for permitting energization and deenergization of said primary winding in response to one and the other of said two output levels of said first signal respectively, second signal generating means for generating a second signal when an engine output shaft arrives at a predetermined angular position close to the top dead center position of said output shaft; and control means, including discriminating means for determining whether an ignition advance angle period starting with the deenergization of said primary coil and ending at the timing of compression top dead center is shorter than a duration period of the high-voltage induced spark discharge, for causing reenergization of the primary winding to interrupt the generated spark discharge in response to said second signal and the other of said two output levels only when said discriminating means determines that said ignition advance angle period is shorter than said duration period.

2. An ignition system according to claim 1, wherein said control means includes:

means for generating a control signal in response to both of said other output level of said first signal and said second signal, said control signal being applied to said switching means to render said switching means conductive irrespective of said other output level of said first signal; and means for disabling the control signal generating operation of said control means when the engine rotation speed is below a predetermined value.

3. A system according to claim 1, wherein said control means includes:

first control means for energizing said primary winding during a predetermined interval of time in response to said second signal under a condition where said first signal generating means generates said other output level of said first signal; and second control means for gradually deenergizing said primary winding after the lapse of said predetermined interval of time.

4. An ignition system according to claim 3, wherein said first control means comprises a first circuit connected to said second signal generating means for generating a control signal having said predetermined interval of time in response to said second signal, said control signal being applied to said switching means to render said switching means conductive to thereby energize said primary winding, and wherein said second control means comprises a second circuit connected in series with said primary winding in parallel relation with said switching means for gradually deenergizing said primary winding when said switching means is rendered nonconductive at the disappearance of said control signal.

5. An ignition system according to claim 3 or 4 further comprising:

means for disabling the energizing and deenergizing operations of said first and second control means when an interval of time between the change of said first signal from said one to the other of two output levels of said first signal and the generation of said second signal exceeds a predetermined value.

6. An ignition system according to claim 3 or 4 further comprising:

means for disabling the energizing and deenergizing operations of said first and second control means when the rotation speed of said output shaft or the load of said internal combustion engine is a respective predetermined value.

7. An ignition system according to claim 1 further comprising:

means for disabling the energizing and deenergizing operations of said control means when an interval of time between the change of said first signal from said one to the other of two output levels of said first signal and the generation of said second signal exceeds a predetermined value.

8. An ignition system according to claim 1 further comprising:

means for disabling the energizing and deenergizing operations of said control means when the rotation speed of said output shaft or the load of said internal combustion engine is below a respective predetermined value.

* * * * *